United States Patent [19]

Thueringer

[11] 4,053,093

[45] Oct. 11, 1977

[54] AIR-ACTUATED STAPLING GUN IMPROVEMENT

[76] Inventor: Stephen E. Thueringer, P.O. Box 284, North Bend, Wash. 98045

[21] Appl. No.: 716,020

[22] Filed: Aug. 19, 1976

Related U.S. Application Data

[63] Continuation-in-part of Ser. No. 636,025, Nov. 28, 1975, abandoned.

[51] Int. Cl.[2] ..... B25C 5/06

[52] U.S. Cl. ..... 227/5; 227/130

[58] Field of Search ..... 227/5, 8, 130

[56] References Cited

U.S. PATENT DOCUMENTS

| | | | |
|---|---|---|---|
| 2,915,754 | 12/1959 | Wandel | 227/5 |
| 3,194,324 | 7/1965 | Langas | 227/8 |
| 3,278,106 | 10/1966 | Becht et al. | 227/8 |
| 3,808,620 | 5/1974 | Rothfuss et al. | 227/130 |

*Primary Examiner*—Granville Y. Custer, Jr.

[57] ABSTRACT

An air-actuated stapling gun that can be conveniently advanced over a stapling surface for automatic-stapling purposes, and this without the necessity of lifting the gun from such stapling surface preparatory to a subsequent staple set. The subject stapling gun retains the double-safety trigger feature common to present-day stapling guns, but includes a wheel mechanism, preferably spring-biased, whereby, once both triggers are and continue to remain manually depressed, the wheel employed, when rolled over a work-piece, will automatically cooperate to fire intermittently the gun. Provision is made for varying interstaple spacing and also for returning the wheel to a "start" position.

4 Claims, 16 Drawing Figures

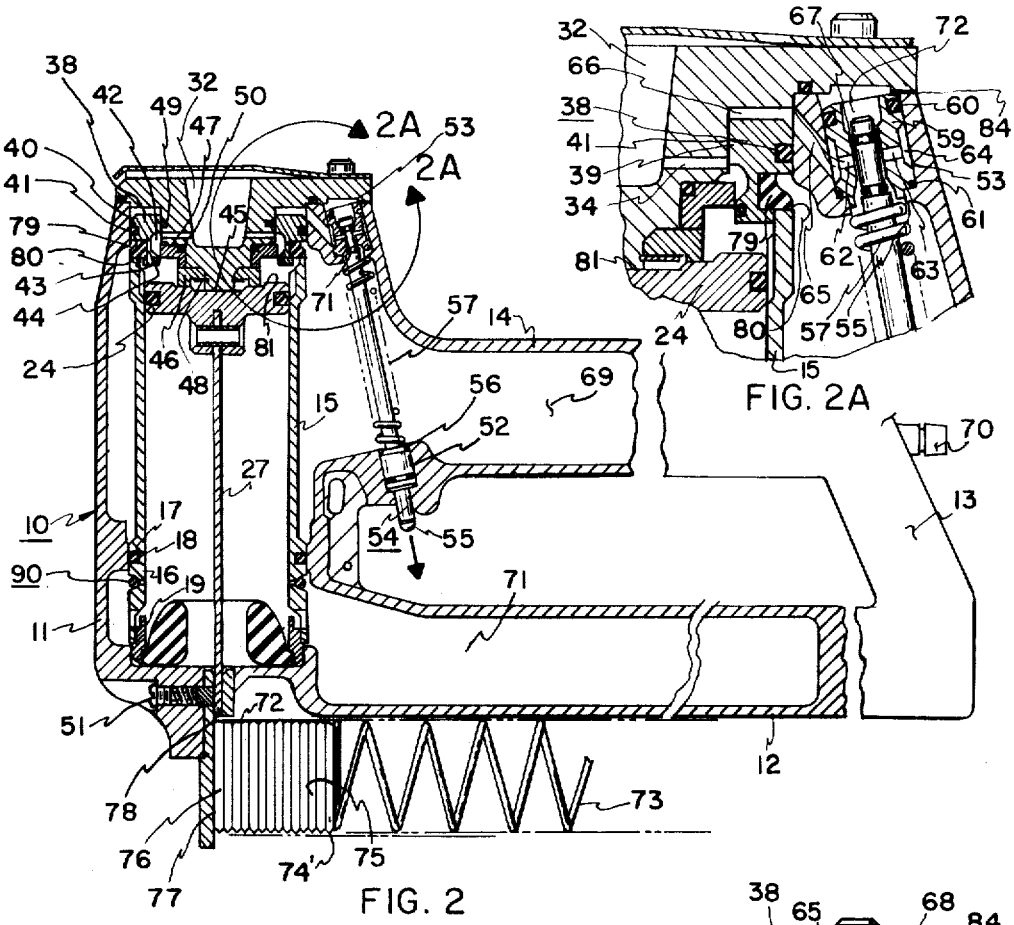
FIG. 2
FIG. 2A
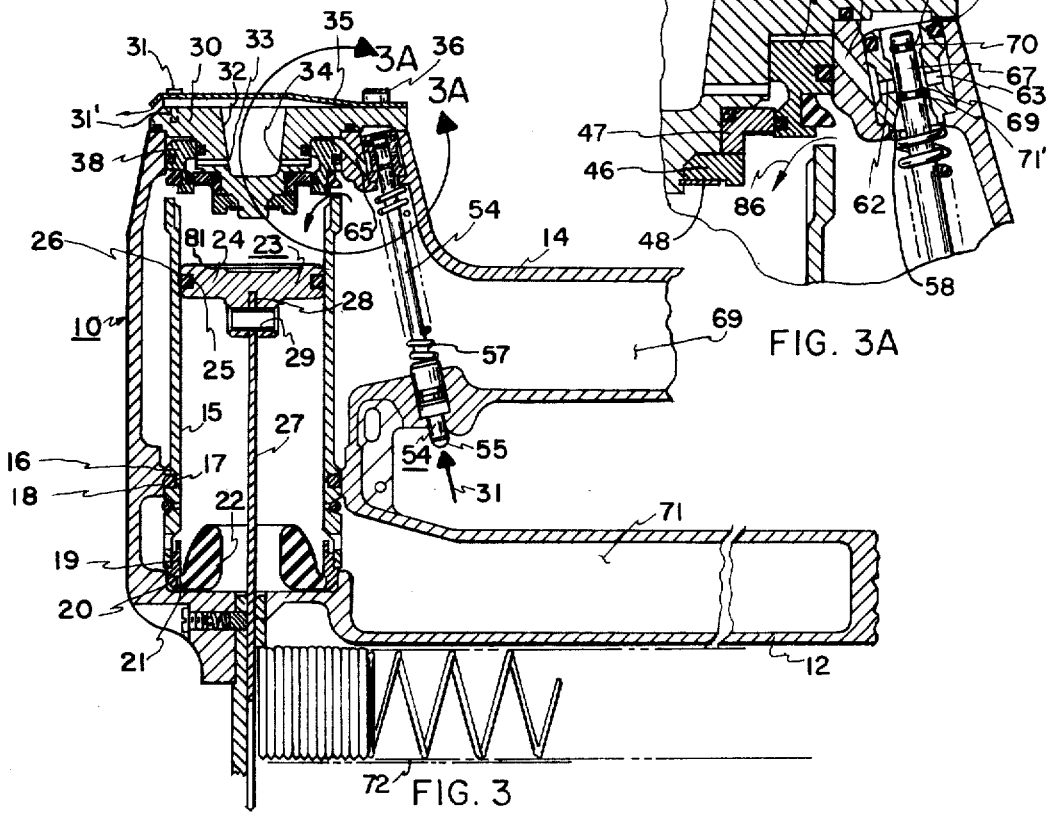
FIG. 3
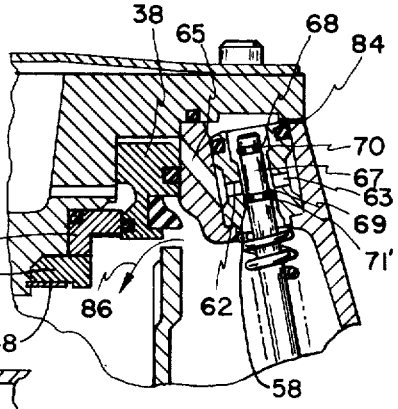
FIG. 3A

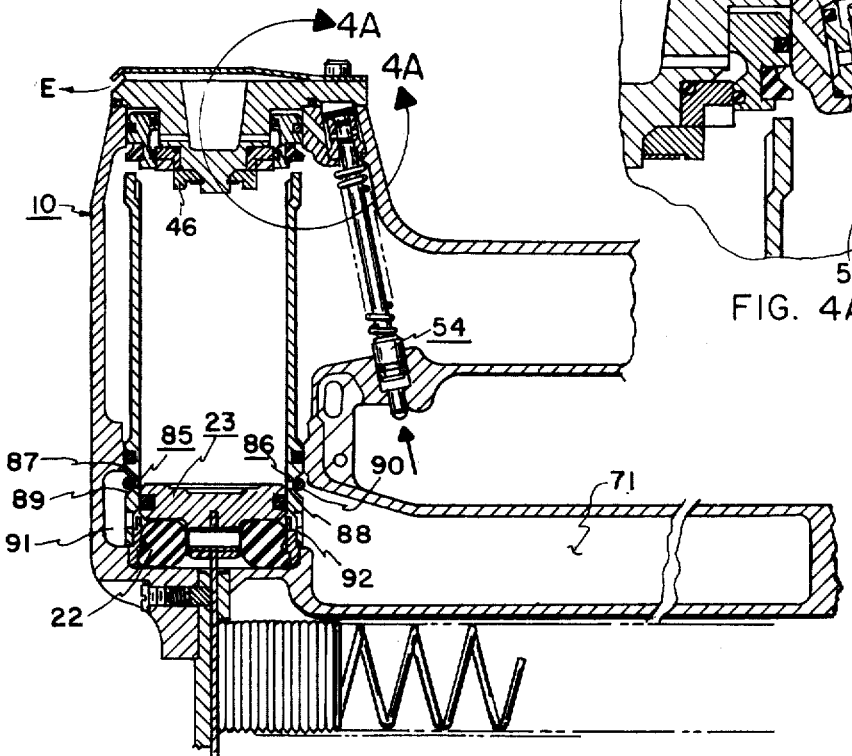
FIG. 4
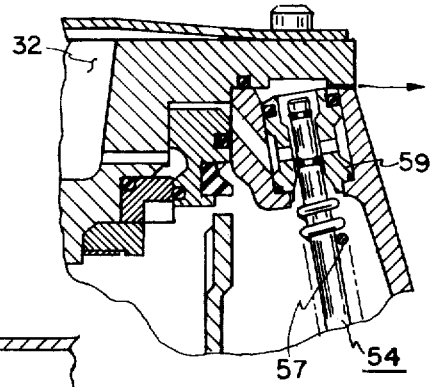
FIG. 4A
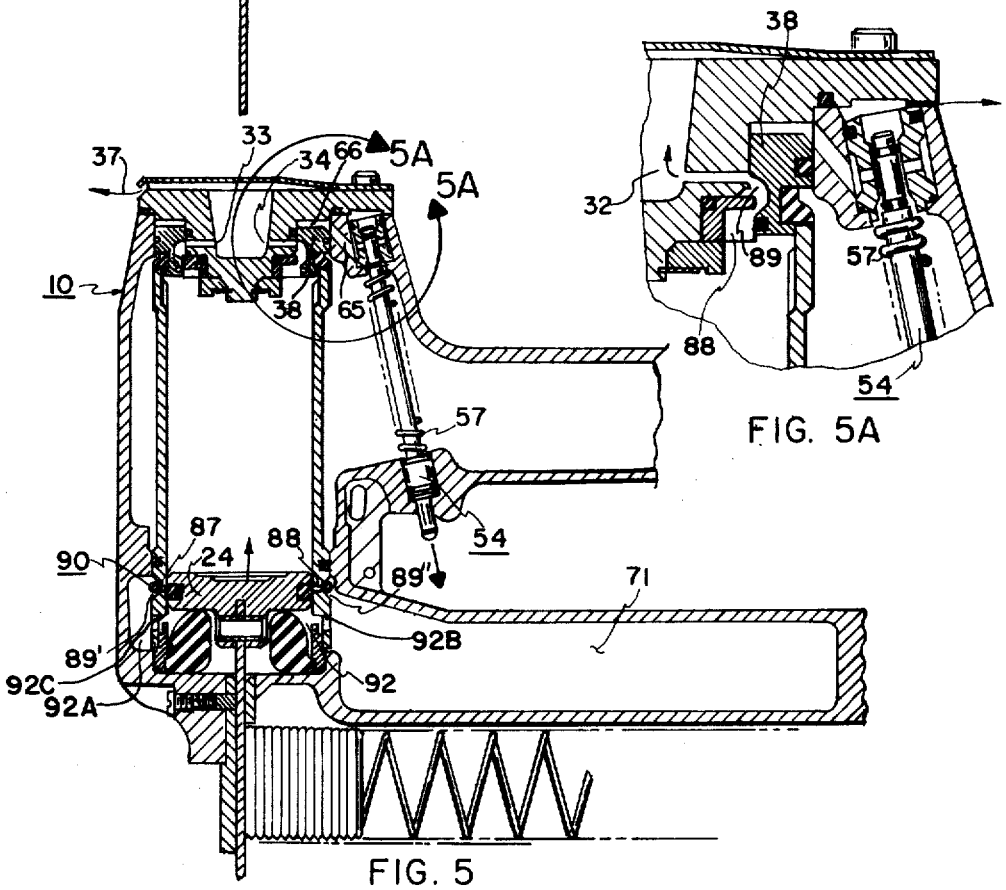
FIG. 5
FIG. 5A

AIR-ACTUATED STAPLING GUN IMPROVEMENT

This is a continuation-in-part of a pending U.S. patent application by the same title, Ser. No. 636,025, filed Nov. 28, 1975, now abandoned.

FIELD OF INVENTION

The present invention relates to air-actuated stapling guns and, more particularly, to new and improved stapling guns of the type described which incorporates both a double-trigger feature and also means for effecting the automatic operation of the gun upon advancement over a work surface, and this without necessitating a lifting of the stapling gun from such surface.

DESCRIPTION OF PRIOR ART

Certain United States patents have issued and bear upon the concept of staplers in general, as follows:

U.S. Pat. Nos.: 2,489,207; 2,756,426; 2,983,922; 2,988,742; 3,170,487; 3,273,777; 3,717,924; 2,915,754; 3,194,324; 3,273,777; 3,612,379.

The above patents all teach the subject of automatic staplers and automatic control thereof but do not set forth automatic-fire stapling wherein (1) friction-wheel means is counterweighted to condition the stapler for immediate firing upon initiation of the next cycle, or (2) friction-wheel orientation flexibility to compensate for off-normal alignment of the stapler relative to the workpiece, both being prime objects and important advantages herein.

There are many air-operated staplers manufactured which resemble that shown and described herein, except for the friction wheel and associated structure, and actuating arm member operatively associated with the trigger system of the unit. The internal valving and air-exhaust features are common in the art and form no part of the invention per se.

Present air-actuated staplers have a needed safety feature which includes a double-trigger mechanism and also a movable nose piece which, even though the trigger mechanism is manually squeezed, nonetheless, must be depressed, i.e. by the stapling surface, in order for the gun to fire. This precludes the inadvertent discharge of a staple where the gun is not proximate and pointing toward a stapling surface. See in this regard U.S. Pat. No. 3,612,379.

However, the guns presently in use require the removal of the stapling gun from the stapling surface prior to the next staple firing. This is inconvenient and time-consuming, and also tires arm muscles which must necessarily be used to lift periodically the stapler from the surface for each stapling function. Also, some incorporate a fixed wheel actuator, see U.S. Pat. No. 2,915,754, but make no provision for tying the use of the same into a double-trigger safety mechanism which must be depressed in order for the wheel to be operative.

In the present invention the double-trigger safety feature, standard with stapling guns, is retained. However, incorporated therewith is structure which precludes the necessity of lifting the stapling gun each time after each staple firing, in order to prepare for a subsequent staple firing or set. Rather, a wheel mechanism, preferably spring-biased, is employed which frictionally engages the stapling surface and revolves in a manner such as to actuate periodically the valving of the gun, the double-trigger mechanism continuing to remain depressed, so as to accomplish successive firings automatically and safely. Inter-spacing of staples may be varied by selecting friction wheels of different sizes and mounting these to the spring-biased slide employed uppermost of the structure. The spring-bias feature of the wheel accommodates tilting of the gun relative to the work surface over which it passes.

BRIEF SUMMARY OF THE INVENTION

The present invention provides an air-actuated stapling gun having conventional valving and double-trigger safety features. At the nose of the stapling gun is a friction wheel, preferably spring-biased, which is designed to actuate a member keyed or otherwise operatively associated with the trigger and valving structure, this is so that as the wheel turns, i.e. as the tool is advanced laterally over a surface to be stapled, then a periodic stapling automatically occurs. Yet, the stapling gun will not fire, even though the trigger mechanism is squeezed, unless the wheel is contacting the surface to be stapled.

OBJECTS

Accordingly, a principal object of the invention is to provide a new and improved air-operated stapling gun.

A further object is to provide a stapling gun having a double-safety trigger feature, but which includes friction-wheel means advanceable over a surface to be stapled which will sequentially operate automatically the trigger and valving structure of the stapling gun.

A further object is to provide an improved air-operated stapling gun which can be operated automatically as the same is advanced over stapling surface, and this even though the gun may be tilted slightly from normal position.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF DRAWINGS

FIG. 2 is an elongate vertical section of the stapler in FIG. 1 wherein the same is disposed in a vertical operating position; for convenience of illustration the figure omits details of the trigger structure, cyclic wheel, and associated structure, this so as to explain the valving operation of the stapler in conjunction with the cyclic operation of the remote control valve core of the stapler.

FIG. 2A is an enlarged detail taken along the arcuate line 2A—2A in FIG. 2.

FIG. 3 illustrates the structure of FIG. 2 when the remote control valve core of the stapler has been depressed, i.e. advanced upwardly relative to the viewer, so as to admit pressured air to the top of the operating cylinder of the structure, thereby causing a descent of such structure.

FIG. 3A is an enlarged detail taken along the arcuate line 3A—3A in FIG. 3.

FIG. 4 is similar to FIG. 3, indicating that the continued depression of the remote control vavle core will produce a lower piston orientation in the manner shown so as to effect a final staple set.

FIG. 4A is an enlarged detail taken along the arcuate line 4A—4A in FIG. 4.

FIG. 5 illustrates a return of the remote control valve core under its spring pressure, once the trigger mechanism is allowed to advance forwardly to its nominal position, whereby to permit pressured air to force the piston upwardly to its original operating condition as shown in FIG. 2.

FIG. 5A is an enlarged detail taken along the arcuate line 5A—5A in FIG. 5

in FIGS. 6 and 7 the eccentric actuator of the friction wheel is shown ready to advance the bail of the actuator rearwardly, i.e. upwardly in these figures, so as to operate the stapler when the trigger mechanism is totally manually depressed from the dotted line position to that shown in section in FIG. 6.

DESCRIPTION OF PREFERRED EMBODIMENTS

Figure 1:
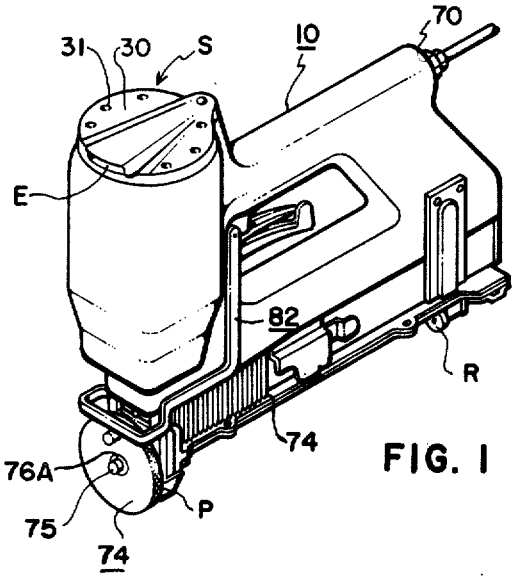
FIG. 1 is a perspective view of an air-actuated stapling gun constructed in accordance with one embodiment of the present invention.

In FIG. 1 the over-all orientation of the stapler is shown in perspective view. At this point it is deemed advisable to consider the operation of the internal valving of the stapler, whereby to illustrate the operation of the stapler in accomplishing a staple advance and set in conjunction with the actuation of the remote control valve core 54. It will be understood that the structure shown in FIGS. 2–5, standing alone, is strictly conventional.

In FIGS. 2–5 stapler housing 10 is shown to include a principal portion 11 and, integral therewith, forward portion 12, bottom portion 13, and rear handle portion 14. Disposed within the housing at its principal portion 11 is a cylinder sleeve 15, the same being provided with raised portion 16 having O-ring groove 17 and O-ring 18. Cylinder sleeve 15 is press-fit over ring 19 which in turn is press-fit into cavity 20 of the over-all stapler housing. Ring 19 includes an annular internal shoulder 21 that is employed for anchoring elastomeric piston stop 22. The main piston assembly 23 includes, of course, a main piston 24 provided with annular groove 25 accommodating O-ring seal 26. Elongate staple driver 27 is pressed into axial groove 28 and is retained in place by retainer pin 29. Closure 30 is provided with a depending opening 32 that communicates with radial apertures 33 and 34. These apertures, as well as this hollow interior or opening 32, provide for exhaust communication of air upwardly under air vent, or deflector 35 that is secured in place by cap screw 36. The member 35 may be made of spring steel, for example, to lend resiliency to the air escape route as shown by arrow 37. A series of cap screws or bolts 31 will secure the cylinder closure 30 to the housing at apertures 31'. A firing valve piston 38 is formed by piston member 39 having peripheral O-ring groove 40 accommodating O-ring 41. This piston includes an interior annular cavity 42 and also an inner seal 43 seated in inner O-ring groove 44. For ease of fabrication, the closure 30 itself will include a protrusion 45 provided with members 46 and 47 which are annular in form and retained in place by a snap-ring or other means 48. Suitable seals or cooperating O-rings are provided at 49 and 50. Adjustment screw 51, in regulating the spring-pressure of compression spring 51A upon friction pad 51B, see FIG. 2, may be thus provided to regulate the thrusting contact of friction pad 51B upon the upper surface of driver 27 and hence the sliding movement of driver 27.

The stapler housing is provided with a bore means at 52 and 53 to accommodate remote control valve core 54. The latter has an actuation end 55 actuatable by trigger structure as hereinafter set forth. Valve core 54 includes annular shoulder 56 that abuts compression spring 57, the latter being seated at spring seat 58 machined into the housing. Remote control valve housing 59 is provided with seals at 60 and 61 and is stationary in position. The same includes radial apertures 62 and 63 and a peripheral groove 64 disposed in communication with passageway 65 and annular cavity 66. The remote control valve core includes reduced portion 67 having grooves 68 and 69 provided with O-ring seals 70 and 71'. Enlarged air passageway area 72 is supplied, which is closed relative to passageway 65 when the valve core is in the position shown in FIG. 2, but also which is opened thereto when the structure assumes a condition as shown in FIG. 3. It is seen in FIG. 2 that the air supply chamber 69 receives positive or raised air pressure at pressured air supply nozzle 70, whereas the piston return air chamber at 71 is at this point at a lower or essentially atmospheric pressure.

The stapler magazine 72 is conventional and includes spring 73 backing the plate 74' that thrusts the staples 75 upwardly, with upper staple 76 being disposed in passageway 77, thus is in line with the driver end 78 of driver 27.

As thus far described, the pneumatic stapler operates in the following manner, i.e. in connection with the depression and return of remote control valve core 54.

Assume first a condition where the core is disposed such that the actuation end 55 is positioned at its lowermost point as shown in FIG. 2. This is to say, the core has not been, but is in position for actuation in a general upward or inner direction.

Thus, in operation the pneumatic stapler shown in FIG. 2 is shown to be ready for actuation. The remote control valve core 54 is shown in its downward position, and supply air positive pressure via passageway 65 and annular cavity 66 to the top surface of firing valve piston 38, from positive air pressure supply cavity 69.

Since atmospheric pressure is present at opening 32 and at passageways 33 and 34, the same communicating to the under-side of firing valve piston 38, such firing valve piston 38 is pressed downwardly against annular seal 79 to seal against the end 80 of cylinder sleeve 15. Accordingly, positive pressure surrounds the cylinder sleeve, as indicated, but as yet is not impressed on the upper surface 81 of the main piston 24. Supply air merely passes over O-ring 71' to be impressed in radial apertures 62 and 63; the same; of course, does not appear at reduced portion 67 by virtue of O-ring seal 70.

Accordingly, the structure as shown in FIG. 2 is in static condition. The device has and needs no internal controls or adjustment. Staples, of course, are spring loaded in a conventional manner, and the structure for accomplishing such has been described hereinbefore.

The remote control valve core 54 is now urged upwardly by external trigger means in the direction of the arrow 31; in such event it is seen in FIG. 3 that the air supply at supply air chamber 69 is shut off from communication with passageway 65 and, in addition, that the radial and communicating apertures at 62 and 63 are now in the position for exhaust to vent 84, see FIG. 3A. Accordingly, since the pressure above the firing valve piston 38 is exhausted and pressure is now exerted on the under-side of such firing exhaust piston, it will raise to the position of FIG. 3 and pressure air will proceed downwardly in the direction of arrow 86 so as to be impressed against the upper surface of main piston 24, to forceably urge in a sudden manner the piston and its driver 27 downwardly to set a staple. It is noted that such action continues until the main piston assembly 23 engages elastomeric piston stop 22, tending to compress the same in the manner shown in FIG. 4 as well as allowing for the flow of air through one-way valves 85 and 86 to cavities 91, 92 and chamber 71. These one-way valves are composed of radial apertures 87 and 88 having valve means 89'' and 89' composed of portions of resilient, elastomeric O-ring 90. Accordingly, the cavities at 92 and 92A now become high-pressured areas wherein pressured air is stored, and this particularly in piston return air chamber 71.

The condition in FIG. 4 will persist until upward pressure against actuation end 55 of the valve core 54 is released.

As seen in FIg. 5, the release of external trigger pressure enables the spring 57 to return the remote control valve core 54 to the position shown in FIG. 5, at which point air pressure is returned through the remote control valve housing to passageway 65 and annular cavity 66, so as to urge the firing valve piston 38 again downwardly as shown in FIG. 1, thereby exhausting air from behind the main piston 24 through annular cavity 42 into radial bores 33 and 34, opening 32, and out vent 35. Simultaneously, the pressured air previously captured in piston return air chamber 71 enters underneath the main piston 24 through passageways 92B, 92C and urges the same rapidly upwardly to its original position. In this regard the member 46 may be elastomeric and serve as a bumper stop in the manner shown in FIG. 2, which temporarily seals passageways 92A, 92B when compressed as in FIG. 4 and then opens these same passageways, see FIG. 5, upon the resiliency of member 46 commencing a return of piston 24.

Accordingly, it is seen that one staple is set at a time when the control valve core 54 is raised upwardly sufficiently to exhaust pressured air from above firing valve piston 38, raise such piston, and thereby permit pressured air to come in as per arrow 86 in FIG. 3A. The piston is returned to its starting position only after pressure is released from actuation end 55 of valve core so as to permit the same to reposition itself downwardly under the spring pressure of compression spring 57.

Figure 10:
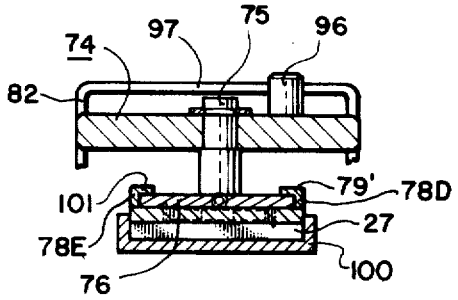
FIG. 10 is an enlarged elevation of the nose of the stapler, indicating the mounting of the friction wheel in relation to associated structure.
Figure 11:
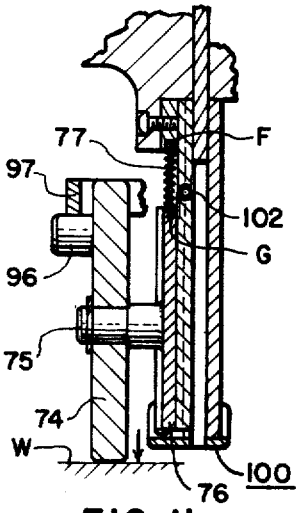
FIG. 11 is a fragmentary side elevation of the front portion of the stapler, just prior to nose depression on the work piece, indicating spring loading of the plate that carries the friction wheel control.

In FIG. 1 the stapler S is seen to have the housing 10 provided with work piece surface engaging wheel 74 that is mounted on pivot pin 75 by snap ring 76A. Pin 75 is also seen in FIGS. 10 and 11, such pin comprising a pivot post that is upstanding from slide member 76. Slide member 76 is backed by spring 77, inserted in apertures F and G, see FIG. 11, which keeps the slide member 76 biased forwardly. An ejection nose 100, formed by channel 78B and cover 78C, is integral with the housing and provides for staple ejection. Cover 78C includes elongate upper angles 78D and 78E providing slide channels 79' and 101 which receive slide member 76, travel-stopped by stop tab 78F. It is seen that a pair of channels 79' and 101 provide for a track for the slide member to advance in and out so as to adjust for any tilting or tipping of the stapler. The ejection nose 100, see FIG. 11, remains closed by the inclusion of a torsion-spring hinge 102, and cover 78C may be lifted so as to withdraw a deformed staple, for example. Double back arm member 82 is generally U-configured looking downwardly having arms 83 and 84 that are essentially L-configured, looking side-ways. These arms include rearward apertures 103 and 104 that accommodate pin 105. Pin 105 is disposed in slide tracks or slide slots 106 and 107 in the housing so that the pin, and hence the arms, may translate back and forth in the general direction of trigger movement. The inner trigger 108 is mounted on pin 105 and is generally loose fitting and positioned so that the same will not actuate the control valve core 54 in FIG. 8, unless the outer trigger member 109 is depressed. Outer trigger member 109 is simply pinned by pin 110 to the housing 10 of the stapler. The spring 102, again, keeps the friction wheel 74 down so that it may adjust to the nose or slide foot 95 of the stapler and thus assume the same level as such slide foot, at least nominally. It is noted that the stapler actuation takes place even though the stapler is tilted from its normal position or 90° relationship relative to the work piece surface at W, through longitudinal adjustment of the friction wheel under its spring bias.

Figure 6:
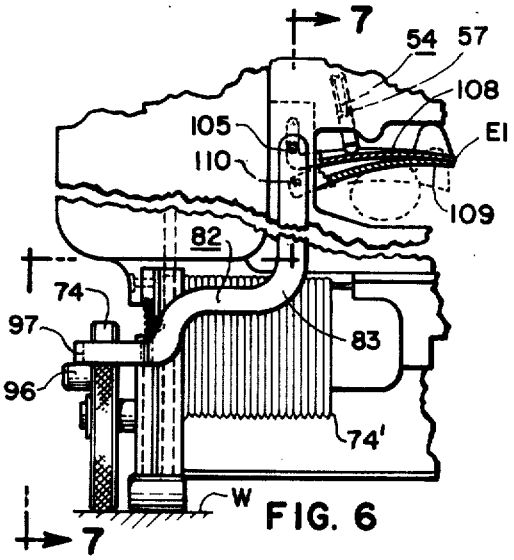
FIG. 6 is an enlarged fragmentary side elevation of the front portion of the structure shown in FIG. 1.

FIG. 6 illustrates the friction wheel 74 engaging the workpiece surface preparatory to eccentric pin actuator 96 thrusting the bail 97 of member 82 rearwardly.

It is noted that the counterweight 98 is provided the friction wheel 74 and is set in the wheel so as preferably to be flush and also oriented downwardly at the beginning of the cycle, that is, to be operative to position the eccentric actuating pin 96 in contact with bail 97 preparatory to the thrusting thereof rearwardly. For the purpose of desirable construction and to avoid catching on clothing, it is desirous that the counterweight 98 be set into a recess 99 of the wheel.

Figure 9:
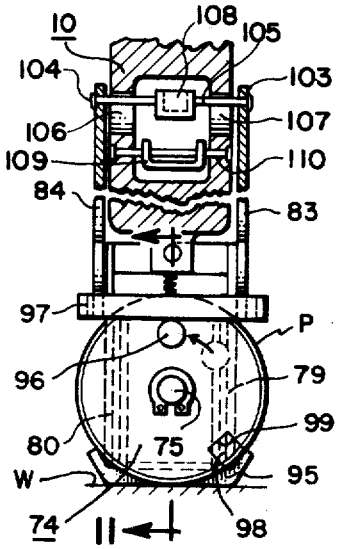
FIG. 9 is a view taken along the line 9—9 in FIG. 8, illustrating new trigger positions, with new positions of associated structure, whereby the stapler has come into a firing position.
Figure 8:
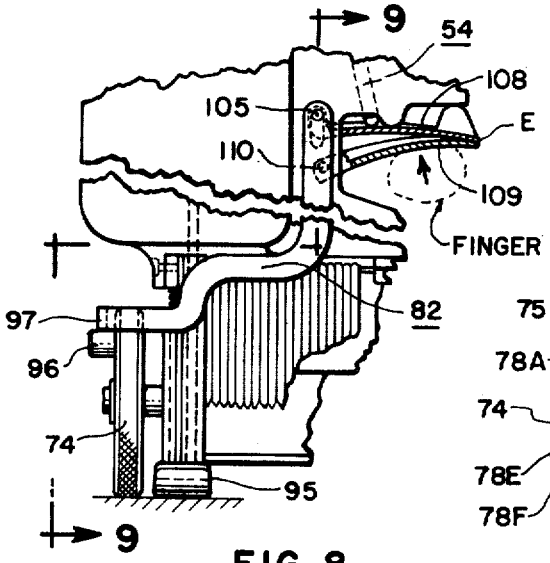
FIG. 8 is similar to FIG. 6 but illustrates the actuator arm member as being translated rearwardly so as to actuate the inner trigger member and thereby advance the control valve core, that controls the valving of the stapler, to fire the same.
Figure 12:
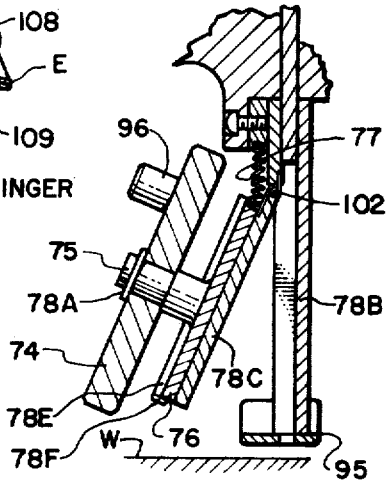
FIG. 12 is similar to FIG. 11 but indicates that the front portion of the stapler may be tipped, against a hinge torsion spring action, so as to remove a defective staple.

In operation, when the actuator 96 advances the bail 97 rearwardly, as in the case shown in FIG. 9, then the arms 83 and 84 advance pin 105 rearwardly, carrying pin 105 and the trigger 90 rearwardly with it.

Where the operator initially depresses the outer trigger member 109, then the inner trigger 108 will be effective to thrust inwardly the valve core 54 in FIG. 8 so as to fire the stapler in the manner indicated in the description relating to FIGS. 2–5, at times of FIG. 9 conditions.

Once the pin or actuator 96 passes the bail, as the same advances in a counterclockwise direction relative to FIG. 9, then the member 82 will return outwardly under the spring pressure of control valve core 54, namely spring 57, with the inner trigger sliding forwardly as does its pin 105.

It is noted that in the absence of the depression of outer trigger member 109, then, since the lower end E1, see FIG. 6, of the inner trigger will be unconfined, rearward advance of the bail 97 and hence of arm member 82 will be ineffective to depress the plunger, i.e. control valve core 54. It is only when the outer trigger is manually "squeezed" or depressed so that the revolving wheel 74 will be operative to push the inner trigger inwardly so as to depress the control valve core 54, does the stapler fire.

Exhaust vent E is seen in both FIGS. 1 and 4. Where desired a roller R may be mounted so as to keep the stapler generally level. In certain applications this will not obviate the need for the wheel 74 being made adjustable by virtue of its spring-biased, i.e. spring 77, so that the periphery P of the wheel will always engage the work surface, whether the stapler be tilted or not.

What is provided, therefore, is a new and improved air operated stapler which has several advantages. In the first place, and regardless of whether there be a safety trigger construction or othwerwise, the spring-biased wheel controlling the valve function of the stapler is operative both for normal position and tilted orientations of the stapler relative to the workpiece surface over which it is advanced 90°. Accordingly, period staplings will occur even though slight tiltings or tippings of the stapler tool exist.

Figure 7:
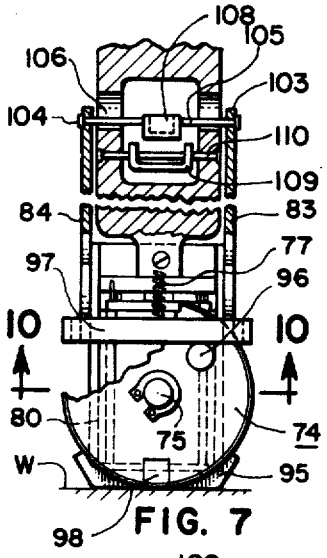
FIG. 7 is a view taken along line 7—7 in FIG. 6, and is broken away to indicate trigger element and safety trigger, with attachment structure.

Secondly, and for all types of staplers, there is provided herein an operating wheel having a counterweight to position the eccentric actuator pin against or proximate the bail of the actuator arm member, as the case may be, so that little area will be traversed by the wheel before the initial staple is set once the stapler is lifted from the workpiece, the counterweight returns the friction wheel to the position shown in FIG. 7.

Finally, the invention provides the double-trigger safety provision of the more recent staplers, but with a friction wheel being provided to actuate the trigger mechanism in a manner such that, only when the trigger is manually depressed, i.e. both the outer safety trigger and the inner trigger element, will the wheel, whether spring-biased or not, be operative to actuate the valve mechanism controlling stapler-piston movement.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. In an air-operated stapling gun having a staple driver, a housing provided with a cylinder, a piston operatively disposed in said cylinder and connected to said staple driver, staple magazine means coupled to said housing and operatively aligned with said staple driver for sequential, single-staple ejection, the combination of said housing and said staple magazine means providing a staple-ejection nose accommodating said staple ejection, said housing being provided with an air-pressure inlet and also air-exhaust vent means, trigger means operatively coupled to said housing and comprising outer and inner trigger elements, and valving means intercoupling said piston and air-pressure inlet and said air-exhaust vent means for enabling air-pressure reciprocation of said piston in successive cycles, said valving means having a valve control means for initiating each of such cycles, said trigger means being cooperatively disposed with respect to said valve control means: an improvement comprising a spring-biased slide member slideably carried by said housing, a work-surface engaging friction wheel pivotally mounted to said slide member and having actuator means and a peripheral surface disposed proximate said ejection nose, and operative means coupled to said inner trigger element, carried by said stapling gun, and proximate to and periodically engaged by said actuator means for actuating said inner trigger element to in turn actuate said valve control element when said outer trigger element is manually depressed.

2. The structure of claim 1 wherein said operative means comprises doubled-back, U-configured arm means.

3. In an air-operated stapling gun having a staple driver, a housing provided with a cylinder, a piston operatively disposed in said cylinder and connected to said staple driver, staple magazine means coupled to said housing and operatively aligned with said staple driver for sequential, single-staple ejection, the combination of said housing and said staple magazine means providing a staple-ejection nose accommodating said staple ejection, said housing being provided with an air-pressure inlet and also air-exhaust vent means, trigger means operatively coupled to said housing and comprising outer and inner trigger elements, operative means coupled to said inner trigger element and carried by said housing for operationally moving said inner trigger element when said outer trigger element is manually depressed, and valving means intercoupling said piston and air-pressure inlet and said air-exhaust vent means for enabling air-pressure reciprocation of said piston in successive cycles, said valving means having a valve control means for initiating each of such cycles, said trigger means being cooperatively disposed with respect to said valve control means: an improvement comprising a work-surface engaging friction wheel carried by said housing and having an eccentrically disposed actuator means and a peripheral surface passing proximate said ejection nose, said wheel including an eccentrically disposed counterweight, separate from said actuator means, disposed to position said wheel so that said actuator means is proximate a beginning, thrusting engagement with said operative means preparatory to stapling gun operation.

4. The structure of claim 3 wherein said counterweight is set in said friction wheel proximate a portion of the periphery thereof.

* * * * *